United States Patent [19]

Friese et al.

[11] Patent Number: 4,729,767

[45] Date of Patent: Mar. 8, 1988

[54] AMPHOTERIC FATLIQUORING COMPOSITION

[75] Inventors: Hans-Herbert Friese, Monheim; Uwe Ploog, Haan; Günter Uphues, Monheim, all of Fed. Rep. of Germany

[73] Assignee: Henkel Kommanditgesellschaft auf Aktien, Duesseldorf, Fed. Rep. of Germany

[21] Appl. No.: 806,740

[22] Filed: Dec. 9, 1985

[30] Foreign Application Priority Data

Dec. 8, 1984 [DE] Fed. Rep. of Germany ..... 3444864

[51] Int. Cl.[4] ..... C14C 5/00; C14C 11/00

[52] U.S. Cl. ..... 8/94.23; 8/94.1 R; 252/8.57

[58] Field of Search ..... 548/352, 347, 354; 8/94.19, 94.20, 94.22, 94.23; 252/8.57

[56] References Cited

U.S. PATENT DOCUMENTS 2,974,000 3/1961 Retzsch et al. ..... 8/94.23

FOREIGN PATENT DOCUMENTS 2219806 10/1973 Fed. Rep. of Germany .
3018201 11/1981 Fed. Rep. of Germany .
599261 3/1948 United Kingdom .
773825 5/1957 United Kingdom .

OTHER PUBLICATIONS

U.S. Ser. No. 485,610, filed 10-18-83 by Henkel.

*Primary Examiner*—Paul Lieberman
*Assistant Examiner*—John F. McNally
*Attorney, Agent, or Firm*—Ernest G. Szoke; Henry E. Millson, Jr.; Mark A. Greenfield

[57] ABSTRACT

A method and composition for fatliquoring during the leather and skin tanning process, in which an amphoteric surfactant is employed which is the condensation product of at least one $C_{6-22}$-fatty acid or corresponding ester with at least an aminoalkylalkanolamine followed by subsequent alkylation reaction with at least one vinylog compound.

17 Claims, No Drawings

AMPHOTERIC FATLIQUORING COMPOSITION

BACKGROUND OF THE INVENTION

1. Field of the Invention

This invention relates to an agent and a process for fatliquoring leather and skins, in which the fat liquoring agent used is an amphoteric surfactant produced by the condensation of $C_{6-22}$-fatty acids (FA) or the corresponding fatty acid esters with certain aminoalkyl alkanolamines.

2. Statement of the Related Art

The production of amphoteric surfactants of the type useful in this invention is described in pending U.S. application Ser. No. 485,610 of Oct. 18, 1983, incorporated herein by reference, and which claims priority from now published German patent application No. 30 18 201, according to which they are synthesized by condensation of $C_{6-22}$ fatty acids with aminoalkyl alkanolamides corresponding to the formula I given below in a mol ratio of 1:1–1.5, and subsequent alkylation with vinylog compounds. The alkylation products may contain optionally quaternized, nitrogen atoms according to their structure and the degree of reaction. Because the condensation products of fatty acid and aminoalkyl alkanolamine generally contain a more or less high percentage of diamide, the alkylation is preferably preceded by an alkaline pretreatment to convert the diamide into the monoamide. This leads in the subsequent alkylation step to improved amphoteric surfactants characterized in particular by increased stability in storage.

DESCRIPTION OF THE INVENTION

This invention provides an amphoteric fatliquoring surfactant in a composition and a method for the agent's use. The surfactant is synthesized by condensation of at least one $C_{6-22}$ fatty acid or the corresponding fatty acid ester with at least one aminoalkyl alkanolamine of the formula:

$$H_2N-(CH_2)_m-NH-(CH_2)_n-OH; \quad (I)$$

wherein:

m=2–6, preferably 2;

n=2 or 3, preferably 2;

followed by subsequent alkylation reaction with at least one vinylog compound.

The starting materials used in the production of the amphoteric surfactants employed in accordance with the invention are at least one preferably saturated or unsaturated $C_{12-22}$-fatty acid or the corresponding fatty acid ester either in the form of pure components or preferably in the form of mixtures of natural or synthetic origin. Examples are: coconut oil fatty acid; tallow fatty acid; train oil fatty acid; rapeseed oil fatty acid mixtures; or their corresponding methyl esters or triglycerides. The amine component is preferably aminoethyl ethanolamine. The reaction is preferably carried out in a mol ratio of fatty acid or fatty acid residue to aminoalkyl alkanolamine of about 1:1–1.5.

The condensation product thus formed contains a percentage of diamides, which may be converted to monoamides by pretreatment with an alkali, in accordance with abovementioned and incorporated U.S. Ser. No. 485,610.

Suitable vinylog compounds include: acrylic acid; methacrylic acid; and their esters, such as methyl acrylate or ethyl methacrylate. In the latter case, the amphoteric surfactants are formed by subsequent hydrolysis of the alkylation products with an aqueous metal hydroxide, especially sodium hydroxide.

The described amphoteric surfactants show high emulsion stability to the salts responsible for the hardness of water, as well as to alkali salts. In the fatliquoring of leather and skins, they give a pleasantly soft, lardy and supple feel after thorough application to the leather. Dye finishes are distinguished by evenness and brilliance. In the case of suede-type leathers, a silky nap with an attractive scribing effect is obtained.

The amphoteric surfactants may be used either alone in the invention method or as a fatliquoring aqueous composition when combined with standard fatliquoring compounds based on sulfated, sulfited or sulfochlorinated oils or fats, such as various synthetic sperm oils, and also in combination with anionic and/or nonionic emulsifiers, such as alkylbenzene sulfonates, fatty alcohol sulfates (FAS), fatty alcohol ethosulfates, fatty acid alkanolamide ethosulfates, sulfosuccinates, fatty alcohol and alkylphenol-etylene oxide adducts. The amount of amphoteric surfactant in the composition is 10–100%, preferably 10 to less than 100%, e.g., 10–90% by weight, based on the total fatliquoring composition. By virtue of the amphoteric character of the claimed products, combinations with cationic fatliquoring agents or emulsifiers, such as dimethyldistearylammonium chloride for example, are also possible. The amphoteric surfactants alone are easy-to-use fatliquoring agents for leathers and skins. They are used in the normal way in the form of aqueous emulsions or solutions in a quantity of 0.5–15, preferably 0.5–6%, by weight of active substance, based on the pared weight of the leather, whether alone in a simple aqueous composition, added to other liquors, or in a fatliquoring composition. As used, the inventive amphoteric surfactant is applied during the tanning process in aqueous emulsion or solution, if alone, or added to other fatliquoring ingredients; if a composition, at a temperature of about 25–70° C., preferably 40–60° C., and for a period of 15–60 min, preferably 25–50 min.

EXAMPLES

A. Production of various amphoteric surfactants

1. Basis-tallow fatty acid 2,117.0 g (8.0 mol) of tallow fatty acid were reacted with 915 g (8.8 mol) of aminoethylethanolamine in the presence of 3 g of 50% hypophosphorous acid (for color stabilization), the reaction being carried out with slow heating to 200° C. in a three-necked flask equipped with a stirrer, thermometer, nitrogen inlet and dephlegmator. The elimination of water began at around 151° C. After stirring for 1 hour at 200° C. under normal pressure and then for another hour under 20 mbar, 2,626 g of aminoamide (tallow-like, yellowish mass having an amine number of 144) were obtained as residue.

To produce the amphoteric surfactant, 4 g of 50% sodium hydroxide and 25 g of water were added at 90° C. to 97.2 g (0.25 mol) of the aminoamide in a three-necked flask equipped with a stirrer and thermometer, followed by stirring for 1 hour at 90°–95° C. to destroy diamide. 316.6 g of water and 18.0 g (0.25 mol) of acrylic acid were then added and the mixture stirred for 5 hours at 85° C. A finely divided dispersion having an active substance content of 25% was obtained.

2. Basis-rapeseed oil fatty acid, rich in erucic acid (55%)

2,191 g (7.0 mol) of rapeseed oil fatty acid rich in erucic acid, 800.0 g (7.7 mol) of aminoethyl ethanolamine and 3.0 g of 50% hypophosphorous acid were reacted as in Example 1, to form the aminoamide. Yield: 2,635 g of a viscous, brown oil, amine number 24.

To produce the amphoteric surfactant, 862.5 g (1.9 mol) of the aminoamide, 30.5 g of 50% sodium hydroxide, 2,969.5 g of water and 137.5 g (1.91 mol) of acrylic acid were reacted in that order in the same way as in Example 1. A finely divided product having an active substance content of 25% was again obtained.

3. Basis-rapeseed oil, low in erucic acid (2%)

In a three-necked flask equipped with a stirrer, thermometer, nitrogen inlet and dephlegmator, 1,109 g (1.25 mol) of rapeseed oil low in erucic acid and 391 g (3.75 mol) of aminoethyl ethanolamine were heated for 3 hours to 180° C. in the presence of 22.5 g of 30% sodium methylate solution, followed by stirring for 3 hours at 180° C. The crude reaction product (aminoamide) was a brownish oil, amine number 142.

To produce the amphoteric surfactant, 847 g (2.14 mol) of the aminoamide were dispersed in 2,000 g of water and reacted with 153 g (2.13 mol) of acrylic acid by stirring for 8 hours at 80°–90° C. The product obtained was a viscous brown liquid containing 33% active substance.

4. Basis-train-type oil fatty acid 2,014 g (7 mol) of train-type oil fatty acid (iodine number 117), 800.8 g (7.7 mol) of aminoethylethanolamine and 3.0 g of hypophosphorous acid were reacted as in Example 1 to form the aminoamide. Yield: 2,450 g of brown oil, amine number 155.

To produce the amphoteric surfactant, 1,267 g (3.5 mol) of the aminoamide, 252 g (3.5 mol) of acrylic acid and 4,500 g of water were reacted together. A viscous brown liquid containing 25% active substance was obtained.

5. Basis-coconut oil fatty acid

In a three-necked flask equipped with a stirrer, thermometer, nitrogen inlet and dephlegmator, 412.0 g (2.0 mol) of coconut oil fatty acid were reacted with 228.8 g (2.2 mol) of aminoethyl ethanolamine in the presence of 0.5 ml of 50% hypophosphorous acid, the reaction being carried out with slow heating to around 200° C. After stirring for 1 hour at 200° C, 46.5 ml of water had been separated. The reaction mixture was then stirred for another hour with more water of reaction and excess amine distillation (in all 47 g). 540.5 g of a pale yellow oil slowly solidifying at room temperature, amine number 180, remained as residue. (a) To produce the amphoteric surfactant, 311.8 g (1 mol) of the aminoamide, 16.2 g of 50% sodium hydroxide solution, 599.0 g of water and 72.0 g (1 mol) of acrylic acid were reacted in that order as in Example 1. The product obtained was a clear, viscous liquid containing approx. 40% active substance. (b) Another reaction was carried out in the same way as in (a), except that 86 g (1 mol) of methyl acrylate were used instead of 72.0 g of acrylic acid. After stirring for 4 hours at 70° C., unreacted methylacrylate was distilled off in vacuo and the crude reaction product was hydrolyzed by addition of 40 g of NaOH and 650 ml of water and heating for 4 hours to 80° C. A clear, viscous liquid having an active substance content of approx. 40% was obtained.

Application Examples

6. Production of garment-quality sheepskin

Material: wet-blue leather % by weight, based on paired weight

| Step | Ingredients | | Time (min) |
|---|---|---|---|
| Washing: | 200% | water 40° C. fresh liquor | 10 |
| | 100% | water 40° C. | 40 |
| | 1% | Na formate | |
| | 1% | Na bicarbonate rinsing 50° C. | |
| Retanning: (with fat-liquor) | 100% | water 50° C. | 30 |
| | 4% | phenol condensate | |
| | 0.5% | ammonia | |
| | 3% | dye | 30 |
| | 3% | (fat liquor) product of Example 5a | 40 |
| | 3% | sulfated ester oil | |
| | 2% | sulfited ester oil | |
| | 3% | acrylate tanning agent | 30 |
| | 0.5% | formic acid | 15 |

Result: Soft leather with a full, rounded feel. Uniform, bloomy dye finish.

7. Brush fatliquouring of rabbit skins 50 parts of the product of Example 3

50 parts of sulfited ester oil.

Emulsify 1:1–2 with water and apply by brush.

Result: Soft, warm, light skins.

8. Production of furniture leather

Material: wet blue leather % by weight, based on pared weight

| Step | Ingredients | | Time (min) |
|---|---|---|---|
| Washing: | 200% | water 45° C. fresh liquor | 10 |
| Retanning: | 100% | water 45° C. | 45 |
| | 2% | chromium sulfate, | |
| | 33% | basic | |
| | 2% | phenol condensate | |
| | 1% | Na aluminum silicate rinsing 40° C. | |
| Neutralization: | 100% | water 40° C. | 60 |
| | 2% | Na bicarbonate fresh liquor | |
| Dyeing and fatliquoring | 100% | water 50° C. | 15 |
| | 2% | naphthalene condensate | |
| | 1% | ammonia | |
| | 3% | dye | 45 |
| | 2% | (fatliquor) product of Example 5a | 45 |
| | 5% | FA sulfated ester oils | |
| | 4% | FA sulfited ester oils | |
| | 1% | FA sulfosuccinate | |
| | 1.5% | formic acid | 15 |
| | 1.5% | formic acid | 30 |

Result: Fabric-soft, warm, slightly lardy furniture leathers are obtained.

9. Production of hide suede

Starting material: crust leather % by weight based on dry weight

| Step | Ingredients | | Time (min) |
|---|---|---|---|
| Whitewashing: | 0.5% | FAS | 120 |
| | 1% | ammonia fresh liquor | |
| Dyeing: (with | 300% | water 60° C. | |
| | 2% | phenol condensate | |

-continued

| Step | Ingredients | Time (min) |
|---|---|---|
| fatliquor) | 1% ammonia | 60 |
| | 7% dye | |
| | 2% formic acid | 15 |
| | 2% formic acid | 30 |
| | 1% (fatliquor) of product of Ex. 3 | 30 |
| | 1.5% cationic fat-liquoring agent | |
| | Wash thoroughly. | |

Result: A silky suede nap with a brillant dye finish and an attractive scribing effect is obtained.

10. Production of hide upper leather .

Material: wet-blue leather % by weight, based on pared weight

| Step | Ingredients | Time (min) |
|---|---|---|
| Washing: | 200% water 40° C. fresh liquor | 10 |
| Neutralization: | 100% water 40° C. | 15 |
| | 0.5% Na formate | |
| | 0.5% Na aluminum silicate | 30 |
| Washing: | 100% water 60° C. fresh liquor | 10 |
| Retanning: (with fatliquor) | 100% water 60° C. | 15 |
| | 2% amphoteric dyeing aid | |
| | 1% dye | 15 |
| | 2% acrylate tanning agent | 15 |
| | 3% phenol condensate | 30 |
| | 2% (fatliquor) product of Ex. 1 | 45 |
| | 3% sulfated fish oil | |
| | 2% chloroparaffin sulfonate | |
| | 0.5% formic acid | 15 |

Result: The leather was very soft (soft leather) with good body and an even, brilliant aniline dye finish.

We claim:

1. A method for fatliquoring leather skins during the tanning process consisting essentially of applying to said leather and skins a fatliquoring effective amount of at least one amphoteric surfactant consisting essentially of: the condensation product of at least one $C_{6-22}$-fatty acid or corresponding ester with at least one aminoalkylalkanolamine of the formula:

$$H_2N—(CH_2)_m—NH—(CH_2)_n—OH$$

wherein m is 2–6, and n is 2 or 3;

followed by subsequent alkylati,on reaction with at least one vinylog compound.

2. The method of claim 1 wherein: said at least one fatty acid or ester is $C_{12-22}$ and is saturated or unsaturated; said condensation reaction is effected between, said fatty acid or ester and said aminoalkylalkanolamine at a mol ratio of 1:1–1.5; said vinylog is at least one of acrylic acid, methacrylic acid, or their ester; and said alkylation is followed by hydrolysis with an aqueous metal hydroxide.

3. The method of claim 1 wherein prior to said alkylation, the condensation product is preceded by an alkaline pretreatment to convert the formed diamide into a monoamide.

4. The method of claim 2 wherein prior to said alkylation, the condensation product is preceded by an alkaline pretreatment to convert the formed diamide into a monoamide.

5. The method of claim 1 wherein said amphoteric surfactant is applied in an amount of 0.5–15% by weight, based upon the pared weight of said leather and skins.

6. The method of claim 2 wherein said amphoteric surfactant is applied in an amount of 0.5–15% by weight, based upon the pared weight of said leather and skins.

7. The method of claim 3 wherein said amphoteric surfactant is applied in an amount of 0.5–15% by weight, based upon the pared weight of said leather and skins.

8. The method of claim 1 wherein said amphoteric surfactant is applied in an amount of 0.5–6% by weight, based upon the pared weight of said leather and skins.

9. The method of claim 4 wherein said amphoteric surfactant is applied in an amount of 0.5–6% by weight, based upon the pared weight of said leather and skins.

10. The method of claim 1 wherein said amphoteric surfactant is applied at a temperature of about 25°–70° C., and for a period of about 15 to 60 minutes.

11. The method of claim 2 wherein said amphoteric surfactant is applied at a temperature of about 40°–60° C. and for a period of about 25–50 minutes.

12. The method of claim 4 wherein said amphoteric surfactant is applied at a temperature of about 40°–60° C. and for a period of about 25–50 minutes.

13. The method of claim 7 wherein said amphoteric surfactant is applied at a temperature of about 40°–60° C. and for a period of about 25–50 minutes.

14. The method of claim 9 wherein said amphoteric surfactant is applied at a temperature of about 40°–60° C. and for a period of about 25–50 minutes.

15. The method of claim 1 wherein said amphoteric surfactant is applied in the form of an aqueous fatliquor emulsion or solution.

16. The method of claim 1 wherein said amphoteric surfactant is applied in the form of a composition consisting essentially of, in addition to said amphoteric surfactant which is present in 10–100% based on the weight of said composition, at least one: sulfated, sulfited, or sulfochlorinated oil or fat; anionic, nonionic or cationic emulsifier; or water.

17. The method of claim 16 wherein said amphoteric surfactant is present in less than 100% by weight.

* * * * *